US007421235B2

(12) United States Patent
Choi

(10) Patent No.: US 7,421,235 B2
(45) Date of Patent: Sep. 2, 2008

(54) ELECTROPHOTOGRAPHIC COLOR IMAGE FORMING APPARATUS

(75) Inventor: Sam-seok Choi, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 357 days.

(21) Appl. No.: 11/372,442

(22) Filed: Mar. 10, 2006

(65) Prior Publication Data

US 2007/0019994 A1 Jan. 25, 2007

(30) Foreign Application Priority Data

Jun. 2, 2005 (KR) ..... 10-2005-0047179

(51) Int. Cl.
*G03G 15/08* (2006.01)

(52) U.S. Cl. ..... 399/263

(58) Field of Classification Search ..... 399/262, 399/263, 254, 256

See application file for complete search history.

(56) References Cited

U.S. PATENT DOCUMENTS 4,473,028 A * 9/1984 Ito et al. ..... 399/254
4,803,515 A * 2/1989 Hoshino et al.
5,826,150 A * 10/1998 Folkins ..... 399/256
6,516,168 B2 * 2/2003 Shiratori et al. ..... 399/262

FOREIGN PATENT DOCUMENTS

| | | |
|---|---|---|
| JP | 05-341589 | 12/1993 |
| JP | 2000-298387 | 10/2000 |
| KR | 1020030037523 | 5/2003 |
| KR | 1020030041101 | 5/2003 |
| KR | 1020040068811 | 8/2004 |

* cited by examiner

*Primary Examiner*—Susan S Lee
(74) *Attorney, Agent, or Firm*—Roylance, Abrams, Berdo & Goodman, L.L.P.

(57) ABSTRACT

An electrophotographic color image forming apparatus is provided having a plurality of developing units that respectively include developer rollers to develop an electrostatic latent image formed on a photoconductor by applying toner to the electrostatic latent image. A plurality of toner cartridges respectively include agitators and are arranged in a lengthwise direction of the developer roller to supply toner to the developing units. A plurality of shafts are connected to each other through a universal joint to transmit rotational motion of a driving motor to the agitators.

14 Claims, 7 Drawing Sheets

ELECTROPHOTOGRAPHIC COLOR IMAGE FORMING APPARATUS

CROSS-REFERENCE TO RELATED PATENT APPLICATION

This application claims the benefit under 35 U.S.C. § 119 (a) of Korean Patent Application No. 10-2005-0047179, filed on Jun. 2, 2005, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an electrophotographic color image forming apparatus with a plurality of developing units.

2. Description of the Related Art

Generally, in a color image forming apparatus using electrophotography, an electrostatic latent image is formed on a photoconductor charged with a uniform potential by applying light to the charged photoconductor. The electrostatic latent image on the photoconductor is developed into a toner image using color toner, and the toner image is transferred and fused to a paper sheet to form a color image on the paper. The electrophotographic color image forming apparatus generally uses yellow (Y), magenta (M), cyan (C), and black (K) toner to form a color image. Therefore, to attach the four toner colors to the electrostatic latent image, the electrophotographic color image forming apparatus requires four developing units that respectively contain the four toner colors. For this reason, the color image forming apparatus is larger than a monochrome image forming apparatus. Also, when toner is used up, the developing unit is entirely replaced with a new one. Though the developing unit contains toner for printing images on several thousand printing media, other parts of the developing unit, such as a developer roller, can be used for printing images on several tens of thousands of printing media. Therefore, replacing the entire developing unit is not economical.

Accordingly, a need exists for an electrophotographic color image forming apparatus in which the entire developing unit does not need to be replaced when one of the color toners is exhausted.

SUMMARY OF THE INVENTION

Embodiments of the present invention provide an electrophotographic color image forming apparatus in which a plurality of toner cartridges are designed to be detachably installed in a plurality of developing units. Therefore, the image forming apparatus may have a smaller size and be used more inexpensively because consumables are replaced less frequently.

According to an aspect of the present invention, an electrophotographic color image forming apparatus includes a photoconductor, and a plurality of developing units respectively including developer rollers to develop an electrostatic latent image formed on the photoconductor by applying toner to the electrostatic latent image. A plurality of toner cartridges respectively include agitators and are arranged in a lengthwise direction of the developer rollers to supply the toner to the developing units. A plurality of shafts are connected to each other through a universal joint to transmit rotational motion of a driving motor to the agitators.

The agitators and the developer rollers may cross each other.

The electrophotographic color image forming apparatus may further include a plurality of pinions respectively coupled to the agitators, and a plurality of worm gears formed on the plurality of shafts to rotate the plurality of pinions.

The plurality of toner cartridges may include black, yellow, cyan, and magenta toner cartridges. The plurality of shafts may include a first shaft connected to the driving motor to drive the agitator of the black toner cartridge and a second shaft to drive the agitators of the yellow, cyan, and magenta toner cartridges. The electrophotographic image forming apparatus may further include a switching unit to selectively transmit driving force to the second shaft.

According to another aspect of the present invention, an electrophotographic color image forming apparatus includes a plurality of developing units placed along a rotational direction of a photoconductor. The developing units respectively include containers in which developer rollers are respectively installed and toner supplying portions extended from the containers. A plurality of toner cartridges are detachably installed to the toner supply portions, respectively. A plurality of pinions are respectively installed to the toner cartridges and have axes substantially perpendicular to the developer rollers. A first shaft is placed in a direction substantially parallel with the developer rollers and connected to a driving motor. A second shaft is connected to the first shaft through a universal joint at a predetermined angle. A plurality of worm gears are formed on the first and second shafts to rotate the plurality of pinions.

The plurality of toner cartridges may include black, yellow, cyan, and magenta toner cartridges. The worm gears may include a worm gear formed on the first shaft to drive the pinion of the black toner cartridge and three worm gears formed on the second shaft to drive the pinions of the yellow, cyan, and magenta toner cartridges.

The electrophotographic color image forming apparatus may further include a switching unit to selectively transmit driving force to the second shaft.

The switching unit may include a spring clutch and a solenoid to selectively operate the spring clutch.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Exemplary embodiments of the present invention will now be described more fully with reference to the accompanying drawings.

Figure 1:
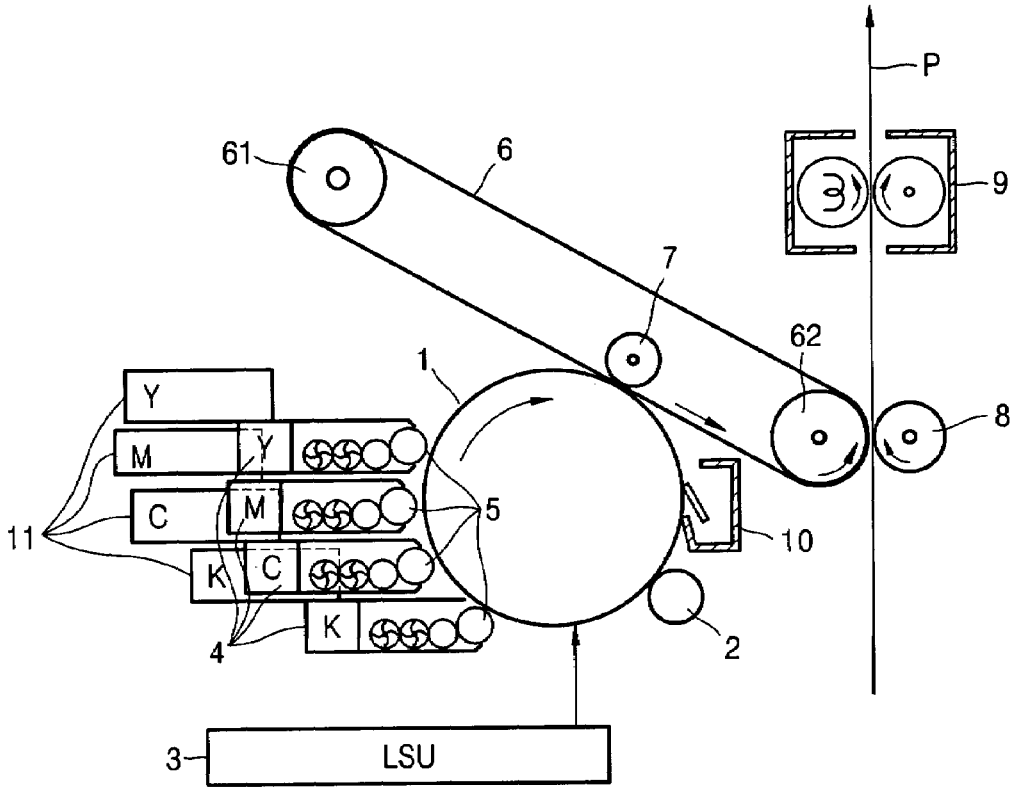
FIG. 1 is a schematic view of an electrophotographic color image forming apparatus with a photoconductive drum according to an exemplary embodiment of the present invention.

FIG. 1 is a schematic view of an electrophotographic color image forming apparatus according to an exemplary embodiment of the present invention. Referring to FIG. 1, an electrophotographic color image forming apparatus includes a photoconductor, such as a photoconductive drum 1, a charge roller 2, an exposing unit 3, a developing cartridge 4, an intermediate transfer belt 6, a first transfer roller 7, a second transfer roller 8, and fuser 9.

The photoconductive drum 1 is a cylindrical metal drum around which a photoconductive layer is formed. Alternatively, a photoconductive belt (refer to 1 a in FIG. 2) may be used instead of the photoconductive drum 1. The charge roller 2 charges the photoconductive drum with a uniform potential. The charge roller 2, as it rotates in contact or non-contact with the photoconductive drum 1, supplies an electric charge to the photoconductive drum 1. Alternatively, a corona discharge device (not shown) may be used instead of the charge roller 2. The exposing unit 3 scans a laser beam across the uniformly charged photoconductive drum 1 to form an electrostatic latent image corresponding to image data. A laser scanning unit (LSU), preferably with a laser diode as a light source, may be used as the exposing unit 3.

In this exemplary embodiment, the image forming apparatus uses cyan (C), magenta (M), yellow (Y), and black (K) toners to print a color image. When necessary to indicate components of the image forming apparatus according to the colors of the toner, Y, M, C, or K is added at the end of reference numeral of the component.

The image forming apparatus includes four toner cartridges 11Y, 11M, 11C, and 11K and four developing units 4Y, 4M, 4C and 4K. The toner cartridges 11Y, 11M, 11C, and 11K contain yellow (Y), magenta (M), cyan (C), and black (K) toner, respectively. The developing units 4Y, 4M, 4C, and 4K receive toner from the toner cartridges 11 Y, 11 M, 11C, and 11K and apply the toner to an electrostatic latent image formed on the photoconductive drum 1 to develop the latent image into a visible toner image. Each of the developing units 4Y, 4M, 4C, and 4K includes a developer roller 5 facing the photoconductive drum 1. The developer roller 5 is spaced apart from the photoconductive drum 1 by a developing gap. The developing gap may be several tens or hundreds of microns. In a multi-pass type image forming apparatus, a plurality of developing units are operated in sequence. The developer roller 5 of a selected developing unit (for example, the developing unit 4Y) may receive a developing bias voltage, and the developer rollers 5 of the other non-selected developing units (for example, the developing units 4M, 4C, and 4K) may either not receive developing bias voltages or receive anti-developing bias voltages. Furthermore, only the developer roller 5 of the selected developing unit (for example, the developing unit 4Y) may be rotated while the developer rollers of the other non-selected developing units (for example, the developing units 4M, 4C, and 4K) may not be rotated.

The intermediate transfer belt 6 is wrapped around support rollers 61 and 62 and it is rotated at substantially the same linear velocity as the photoconductive drum 1. The length of the intermediate transfer belt 6 is substantially equal to or larger than that of the largest printing medium of the image forming apparatus. The first transfer roller 7 faces the photoconductive drum 1 with the intermediate transfer belt 6 therebetween. A first transfer bias voltage is applied to the first transfer roller 7 to transfer a toner image from the photoconductive drum 1 to the intermediate transfer belt 6. The second transfer roller 8 faces the intermediate transfer belt 6. During the transferring of the toner image from the photoconductive drum 1 to the intermediate transfer belt 6, the second transfer roller 8 is spaced apart from the intermediate transfer belt 6. After the transferring, the second transfer roller 8 is pressed against the intermediate transfer belt 6 and a second transfer bias voltage is applied to the second transfer roller 8 to transfer the toner image from the intermediate transfer belt 6 to a printing medium passing through between the second transfer roller 8 and the intermediate transfer belt 6. A waste toner cleaner 10 removes waste toner from the photoconductive drum 1 after transferring the toner image.

An operation of the image forming apparatus will now be described. The charge roller 2 uniformly charges the photoconductive drum 1, and the exposing unit 3 scans a beam corresponding to, for example, yellow color information of image data to the photoconductive drum 1 to form an electrostatic latent image corresponding to the yellow color information. A developing bias voltage is applied to the developer roller 5 of the yellow developing unit 4Y to develop the yellow electrostatic latent image into a visible yellow toner image by applying yellow toner to the yellow electrostatic latent image. A first transfer bias voltage is applied to the first transfer roller 7 to transfer the yellow toner image from the photoconductive drum 1 to the intermediate transfer belt 6. After the yellow toner image corresponding to one page is transferred to the intermediate transfer belt 6, the charge roller 2 uniformly charges the photoconductive drum 1 again. A beam corresponding to, for example, magenta color information of the image data is then scanned to the photoconductive drum 1 to form a magenta electrostatic latent image. The magenta developing unit 4M applies magenta toner to the magenta electrostatic latent image to develop it into a visible magenta toner image. The magenta toner image is transferred from the photoconductive drum 1 to the intermediate transfer belt 6 in overlapping relationship with the yellow toner image that is already transferred to the intermediate transfer belt 6. Cyan and black toner images are formed and transferred to the intermediate transfer belt 6 in substantially the same manner. That is, the yellow, magenta, cyan, and black toner images are sequentially overlapped on the intermediate transfer belt 6 to form a color toner image corresponding to the image data to be printed. When a printing medium passes through between the intermediate transfer belt 6 and the second transfer roller 8, a second transfer bias voltage is applied to the second transfer roller 8 to transfer the color toner image from the intermediate transfer belt 6 to the printing medium P. The fuser 9 applies heat and pressure to the color toner image to securely attach the color toner image on the printing medium P. Thus, a multi-pass type color image forming apparatus may be implemented using one photoconductive drum 1, one exposing unit 3, and four developing units 4Y, 4M, 4C and 4K.

Figure 3:
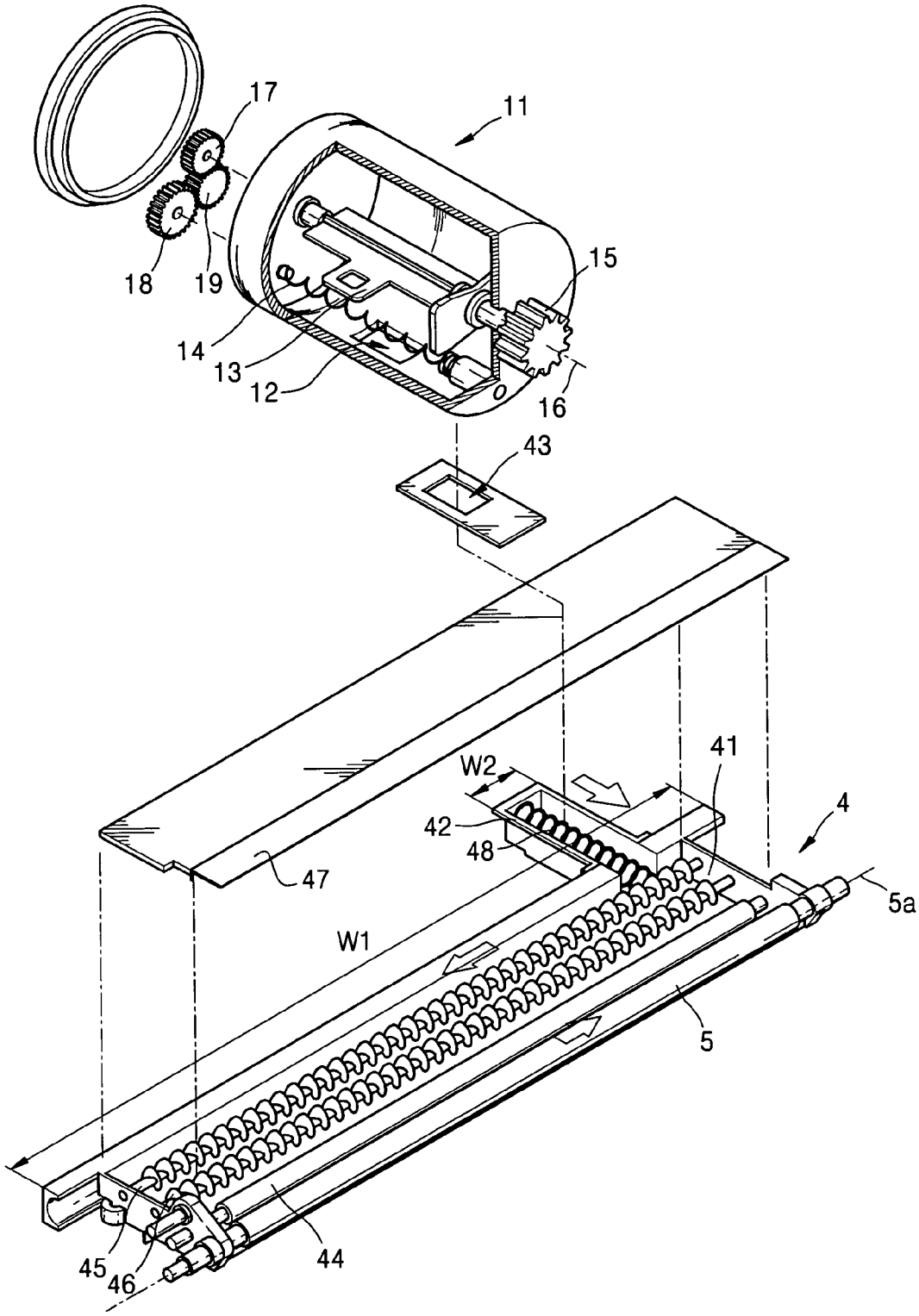
FIG. 3 is an exploded perspective view of a developing unit and a toner cartridge according to an exemplary embodiment of the present invention.

In an exemplary embodiment, the toner cartridge 11 is removably installed in the developing unit 4. FIG. 3 is an exploded perspective view showing the relationship between the developing unit 4 and the toner cartridge 11, in which the toner cartridge 11 is cut away for better illustration. Referring to FIG. 3, the developing unit 4 includes a toner supplying portion 42 and a container 41 that holds the developer roller 5. The toner supplying portion 42 defines a hole 43 to receive toner from the toner cartridge 11. The toner supplying portion 42 may include a toner transferring part, such as a spiral coil 48, to transport the toner received from the toner cartridge 11 to the container 41. Alternative toner transferring parts, such as an auger and transportation belt (not shown), may be used. In the container 41, a first auger 45, a second auger 46, and a toner-supply roller 44 are installed. The first and second augers 45 and 46 transport the toner from the toner supplying portion 42 to the developer roller 5. The first and second augers 45 and 46 may transport the toner in opposite directions as indicated by arrows in FIG. 3. The toner-supply roller 44 contacts the developer roller 5. As the toner-supply roller 44 rotates it applies toner (which is preferably non-magnetic) to the developer roller 5 by frictional charging. A doctor blade 47 regulates the thickness of toner on the developer roller 5.

The toner cartridge 11 includes a discharge hole 12 and a shutter (not shown in detail). The shutter opens the discharge hole 12 when the toner cartridge 11 is installed in the image forming apparatus, and it closes the discharge hole 12 when the toner cartridge 11 is removed from the image forming apparatus. Therefore, when toner is used up, only the toner cartridge 11 is replaced with new one instead of replacing the entire developing unit 4. That is, the developing unit 4 may be used for its life span and then replaced with a new one, thereby reducing operational costs of the image forming apparatus.

The toner supplying portion 42 extends rearwardly from the container 41. According to this structure, the developing unit 4 may have a slim shape compared to when the toner supplying portion 42 is located at an upper portion of the container 41. For example, the developing unit 4 may have a thickness of approximately 15 mm or less when a 10 mm diameter developer roller 5 is used.

Figure 2:
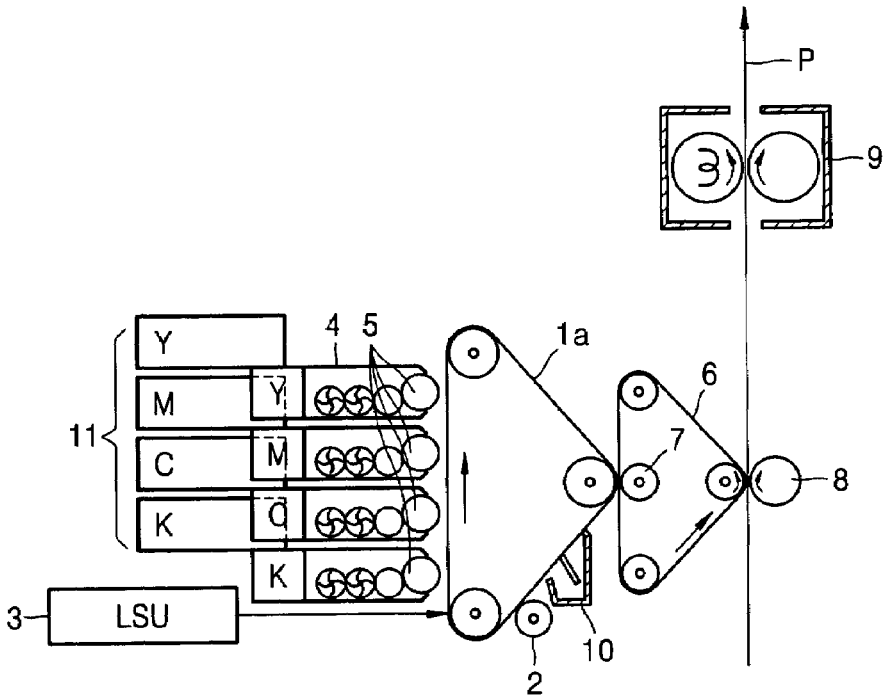
FIG. 2 is a schematic view of an electrophotographic color image forming apparatus with a photoconductive belt according to another exemplary embodiment of the present invention.
Figure 4:
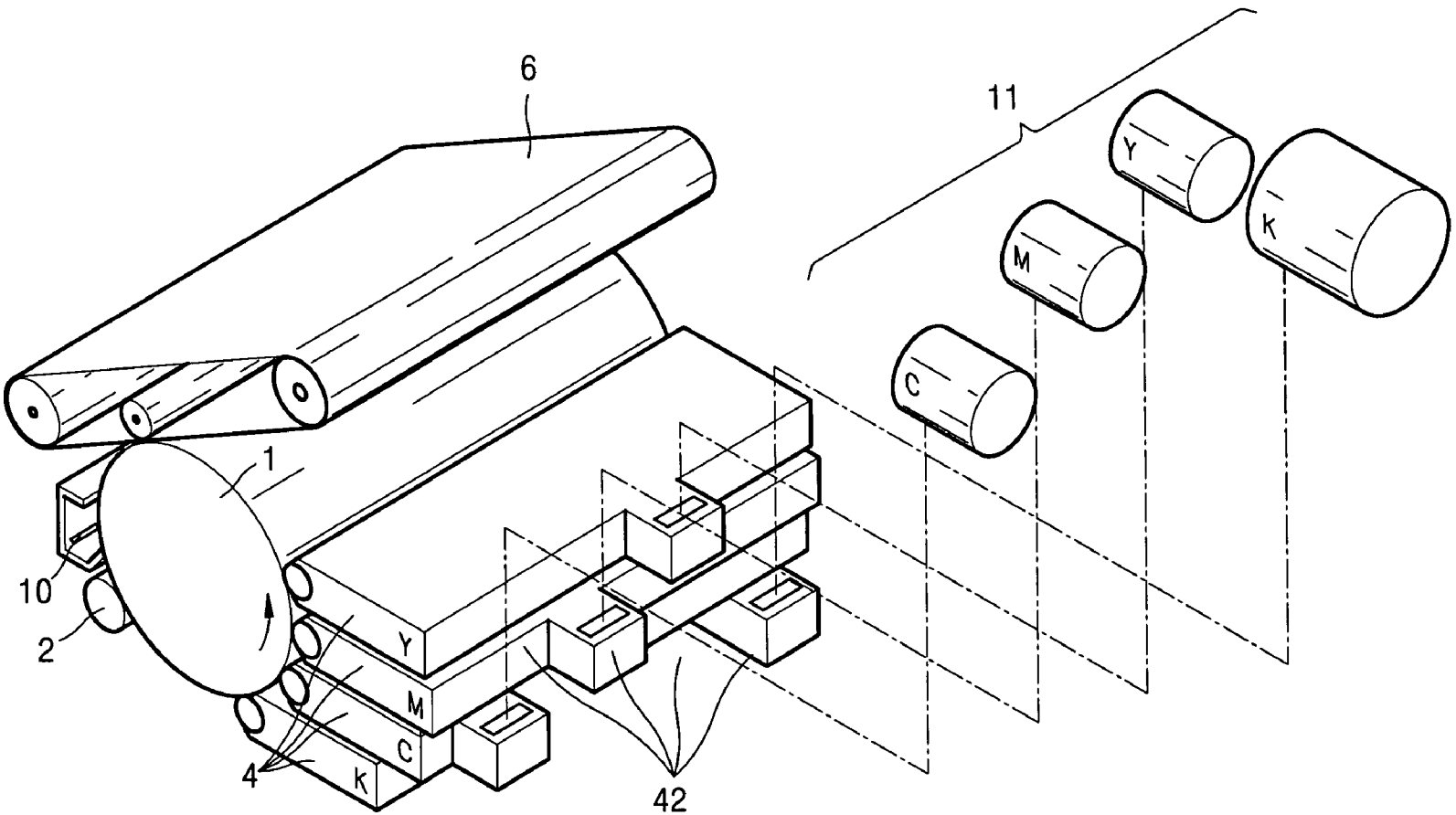
FIG. 4 is an exploded perspective view of an arrangement of toner-supply portions of developing units according to an exemplary embodiment of the present invention.
Figure 5:
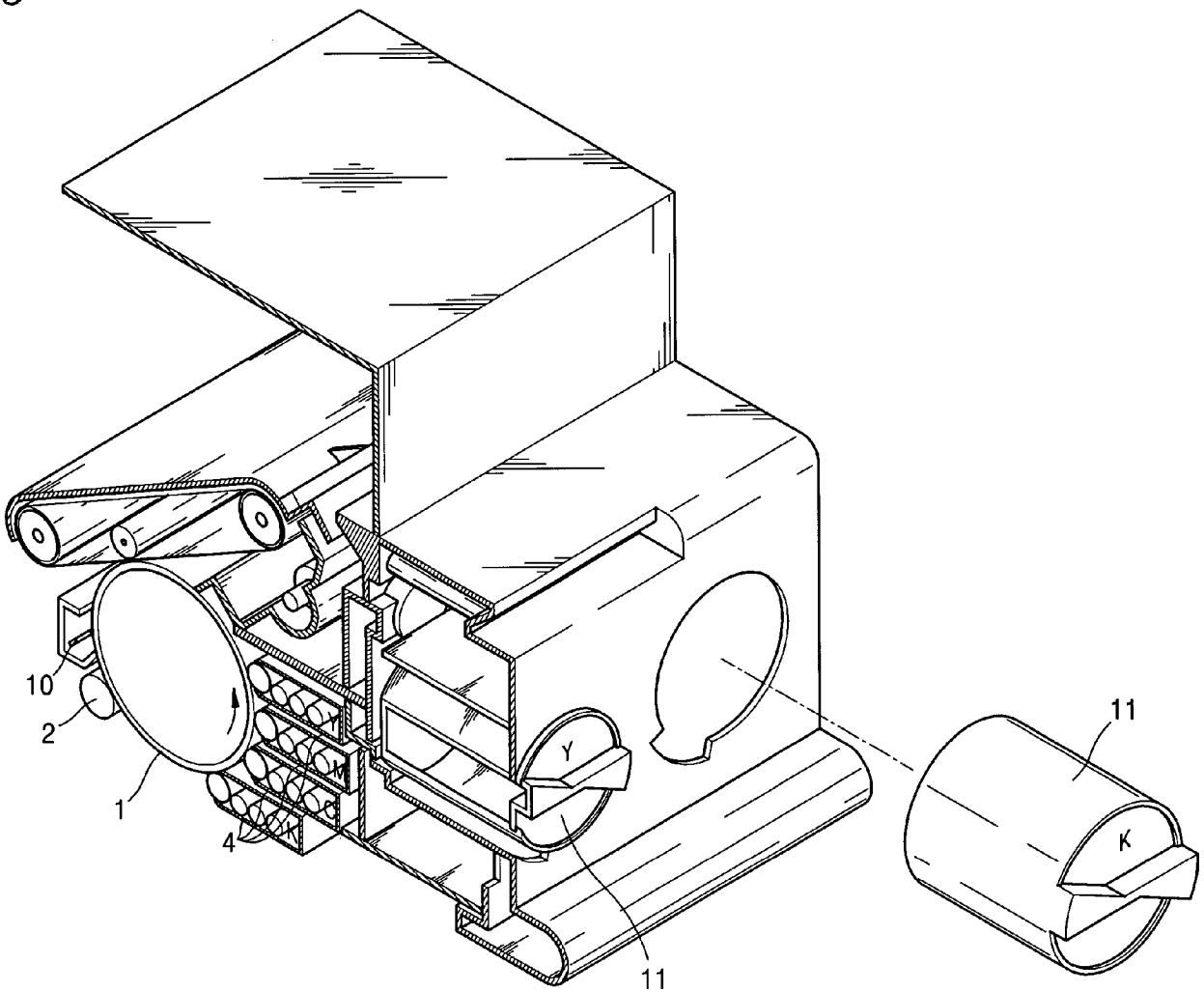
FIG. 5 is a perspective view showing replacement of a toner cartridge according to an exemplary embodiment of the present invention.

The toner supplying portion 42 has a width W2, which may be narrower than a width W1 of the container 41. The supplying portion 42 may define the hole 43 in an upper side to freely receive toner from the toner cartridge 11 under the influence of gravity. The four developing units 4Y, 4M, 4C, and 4K are arranged in the moving direction of the photoconductor 1 or la, as shown in FIGS. 1 and 2. The arranged order of the four developing units 4Y, 4M, 4C, and 4K is not limited to the order shown in FIGS. 1 and 2. Referring to FIG. 4, the toner supplying portions 42 of the four developing units 4Y, 4M, 4C, and 4K are staggered in a lengthwise direction of the developing unit 4 to substantially prevent the four toner cartridges 11Y, 11M, 11C, and 11K from interfering with each other. The lower three toner cartridges 11M, 11C, and 11K are overlapped with the upper developing units 4Y, 4M, and 4C when viewed from the front, as shown in FIGS. 1 and 2, such that the increase in the height of the image forming apparatus due to the four toner cartridges 11Y, 11M, 11C, and 11K is minimized. Furthermore, the supplying portions 42 are arranged to substantially prevent interference between the four toner cartridges 11Y, 11M, 11C, and 11K or between the four toner cartridges 11Y, 11M, 11C, and 11K and the four developing units 4Y, 4M, 4C, and 4K. Therefore, the image forming apparatus partially exposes the toner cartridges 11Y, 11M, 11C, and 11K when they are installed as shown in FIG. 5. The toner cartridges 11Y, 11M, 11C, and 11K may be installed in and removed from the image forming apparatus without opening the image forming apparatus. This provides a convenient way of replacing the toner cartridges 11Y, 11M, 11C, and 11K.

Referring again to FIG. 3, the toner cartridge 11 includes an agitator 13 to stir toner to prevent caking of the toner and to send the toner to the discharge hole 12. The toner cartridge 11 may further include a transportation coil 14 to facilitate the movement of the toner to the discharge hole 12. The toner cartridge 11 further includes a pinion 15 to rotate rotary components, such as the agitator 13 and the transportation coil 14. The pinion 15 drives rotary components of the toner cartridge 11 such as the agitator 13 and the transportation coil 14. In this embodiment, the pinion 15 is coupled to the agitator 13. A gear is coupled to the transportation coil 14. A gear 18 is connected to a gear 17, which is coupled to the agitator 13, via a gear 19. An axis 16 of the agitator 13 is substantially perpendicular to an axis 5*a* of the developer roller 5.

Figure 6:
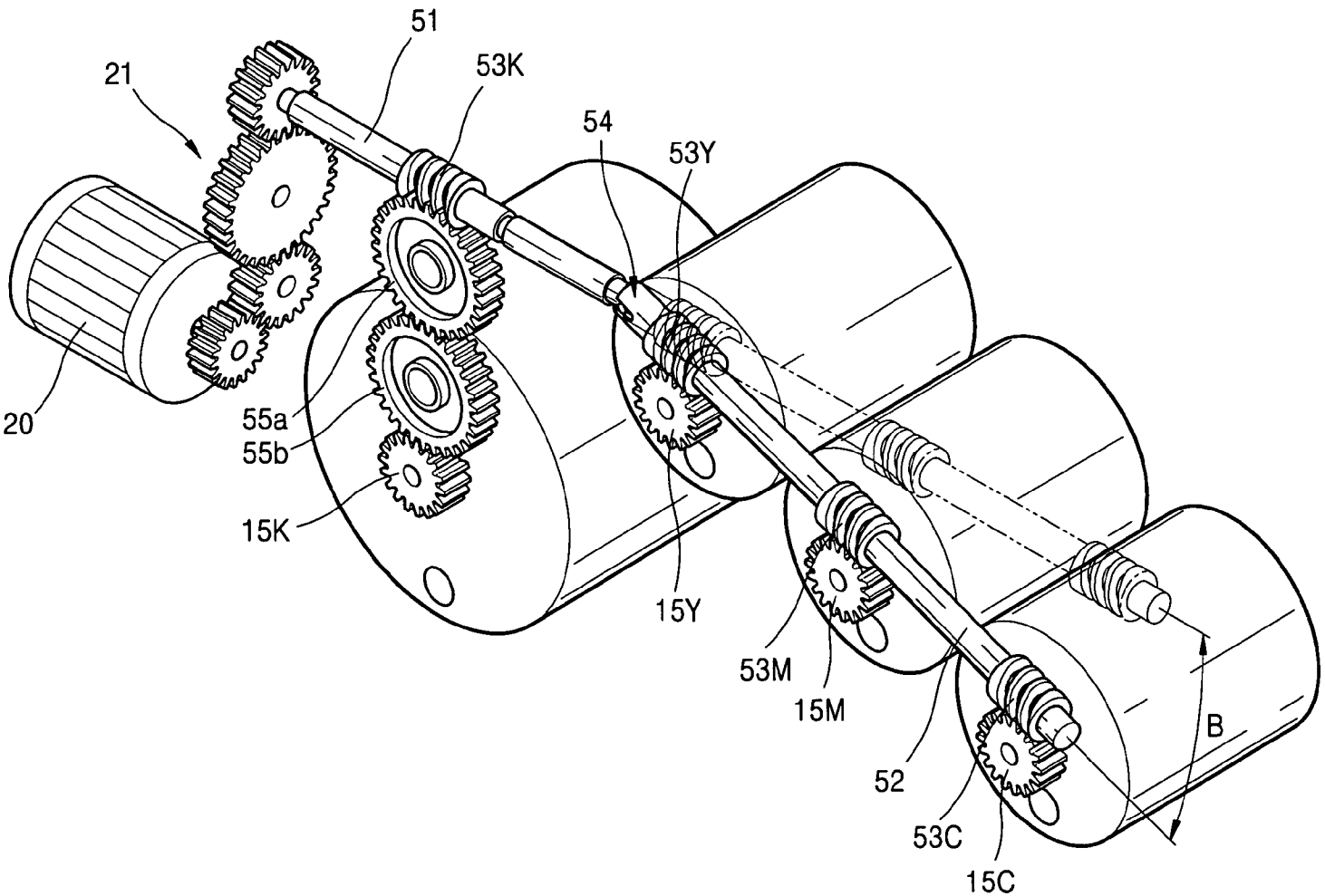
FIG. 6 is a perspective view of an example of a cartridge driving unit for driving a plurality of toner cartridges according to an exemplary embodiment of the present invention.

Referring to FIG. 6, the image forming apparatus includes a driving motor 20, a first shaft 51, and a second shaft 52 to drive pinions 15Y, 15M, 15C, and 15K of the toner cartridges 11Y, 11M, 11C, and 11K. The first shaft 51 is substantially parallel to the developer roller 5. The driving motor 20 is connected to the first shaft 51 through gear assembly 21. The driving motor 20 may drive only the pinions 15Y, 15M, 15C, and 15K of the toner cartridges 11Y, 11M, 11C, and 11K. Alternatively, the driving motor 20 may also drive other rotary components, such as the development roller 5, the photoconductive drum 1, and the intermediate transfer belt 6. The second shaft 52 is connected to the first shaft 51 at an angle B through a universal joint 54. The first and second shafts 51 and 52 are formed with four worm gears 53Y, 53M, 53C, and 53K that are respectively connected to the pinions 15Y, 15M, 15C, and 15K of the toner cartridges 11Y, 11M, 11C, and 11K. Since the lowest pinion 15K of the toner cartridge 11K is spaced apart from the worm gear 53K, idle gears 55*a* and 55*b* are placed between the pinion 15K and the worm gear 53K. Other pinions 15Y, 15M, and 15C are preferably directly connected to the worm gears 53Y, 53M, and 53C.

Alternatively, the first shaft 51 may be further elongated and formed with all the four worm gears 53Y, 53M, 53C, and 53K, as shown by imaginary line in FIG. 6, and additional idle gears, similar to idle gears 55*a* and 55*b*, are used to connect the pinion 15Y, 15M, and 15C with the worm gears 53Y, 53M, and 53C. That is, because the second shaft 52 is connected to the first shaft 51 at the angle B by using the universal joint 54, the pinions 15Y, 15M, and 15C may be directly connected to the worm gears 53Y, 53M, and 53C without additional idle gears. Therefore, power may be transmitted from the driving motor 20 to the pinions 15Y, 15M, 15C, and 15K with fewer components. Because the agitator 13 is preferably not rotated at a high speed, the driving motor 20 rotates the pinions 15Y, 15M, 15C, and 15K with a high gear ratio when the driving motor 20 is also used to rotate other components, such as the development roller 5, the photoconductive drum 1, and the intermediate transfer belt 6. The combination of the worm gear 53 and the pinion 15 may simply provide a high gear ratio.

Figure 7:
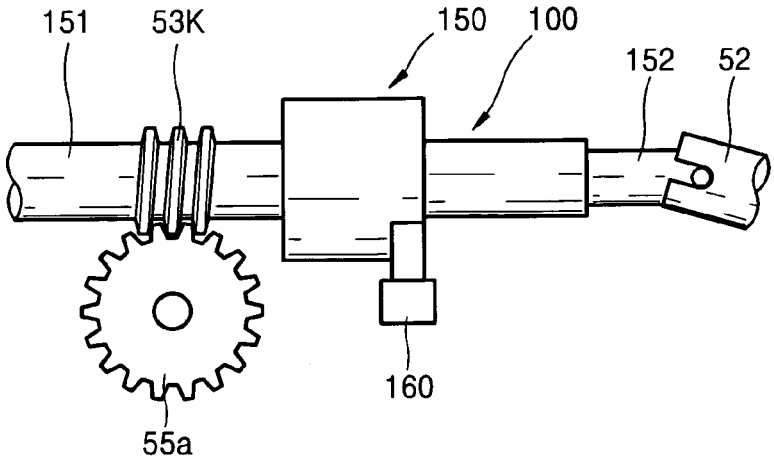
FIG. 7 is a front view of an alternative cartridge driving unit for driving a plurality of toner cartridges according to another exemplary embodiment of the present invention.

When printing a color image, all four developing units 4Y, 4M, 4C, and 4K are operated. However, when printing a monochrome image (such as a black and white image), only the black developing unit 4K is operated. That is, the agitators 13 of the toner cartridges 11Y, 11M, and 11C do not need to be rotated. For this, the image forming apparatus may further include a switching unit 100, as shown in FIG. 7. The switching unit 100 selectively connects the second shaft 52 to the first shaft 51. For example, the first shaft 51 may be divided into a driving shaft 151 and a driven shaft 152. The first shaft 151 is formed with the worm gear 53K, and the driven shaft 152 has one end connected to the driving shaft 151 through a spring clutch 150 and the other end connected to the second shaft 52 through the universal joint 54. A solenoid 160 selectively operates the spring clutch 150 to connect and disconnect the driving shaft 151 and the driven shaft 152.

Figure 8:
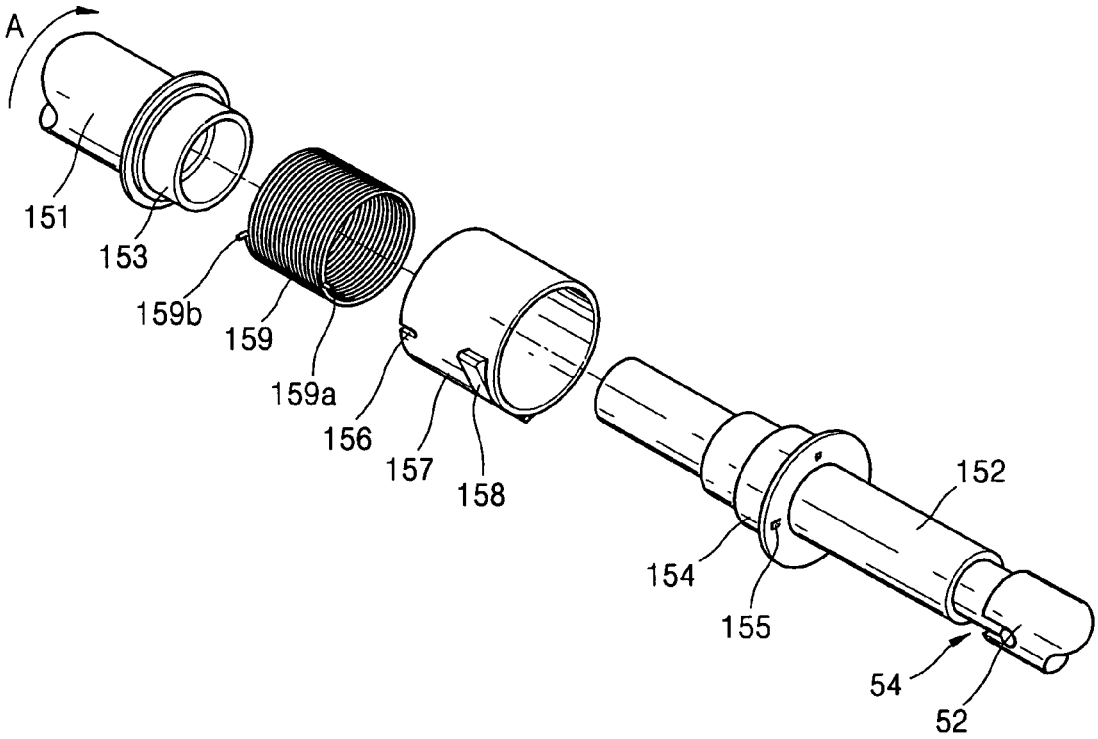
FIG. 8 is an exploded perspective view of an example of a spring clutch according to an exemplary embodiment of the present invention.

FIG. 8 is an exploded perspective view showing an example of a spring clutch according to an exemplary embodiment of the present invention. Referring to FIG. 8, a springing clutch 150 includes a clutch spring 159 and a clutch hub 157. The clutch spring 159 includes one side fitted around an end 153 of the driving shaft 151 and the other side fitted around an end 154 of the driven shaft 152. The clutch hub 157 encloses the clutch spring 159. The clutch hub 157 is formed with a coupling protrusion 158. The clutch spring 159 further includes one end 159*a* inserted in a hole 155 of the driven shaft 152 and the other end 159*b* inserted in a hole 156 of the clutch hub 157. When the driving shaft 151 is rotated by the driving motor 20 in a direction indicated by arrow A, the clutch spring 159 is twisted. This twisting narrows the inner diameter of the clutch spring 159 to tightly hold the ends 153 and 154 of the driving shaft 151 and the driven shaft 152, such that the driven shaft 152 is rotated in the direction of arrow A by the driving shaft 151. The clutch hub 157 is also rotated in the direction of arrow A because the other end 159*b* of the clutch spring 159 is inserted in the hole 156 of the clutch hub 157.

Figure 9:
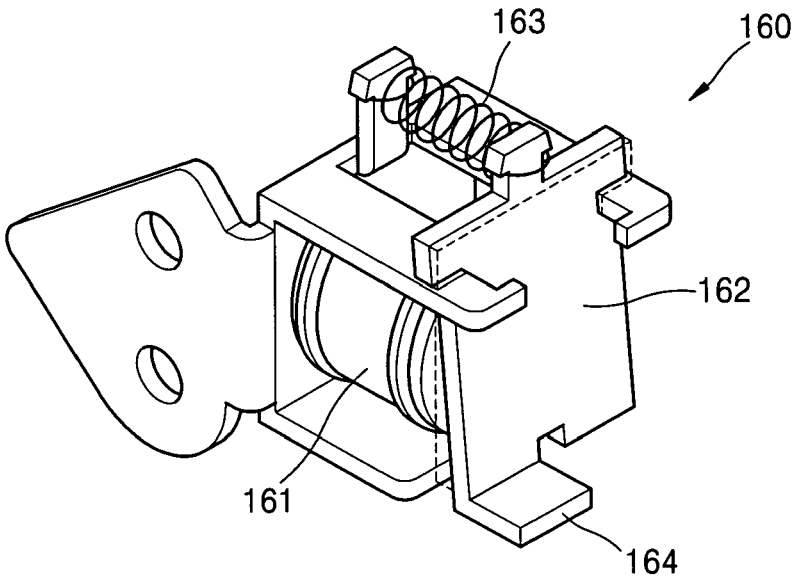
FIG. 9 is a perspective view of an example of a solenoid according to an exemplary embodiment of the present invention.

FIG. 9 is a perspective view showing an example of a solenoid according to an exemplary embodiment of the present invention. Referring to FIG. 9, a solenoid 160 includes a coil 161, a shifting plate 162, and a spring 163. The shifting plate 162 includes a stopping portion 164 at an end. When current is applied to the coil 161, the shifting plate 162 is pulled toward the coil 161 as shown by imaginary line in FIGS. 9 and 10. When the current is switched off, the shifting plate 162 is returned to its original position by the elastic force of the spring 163.

Figure 10:
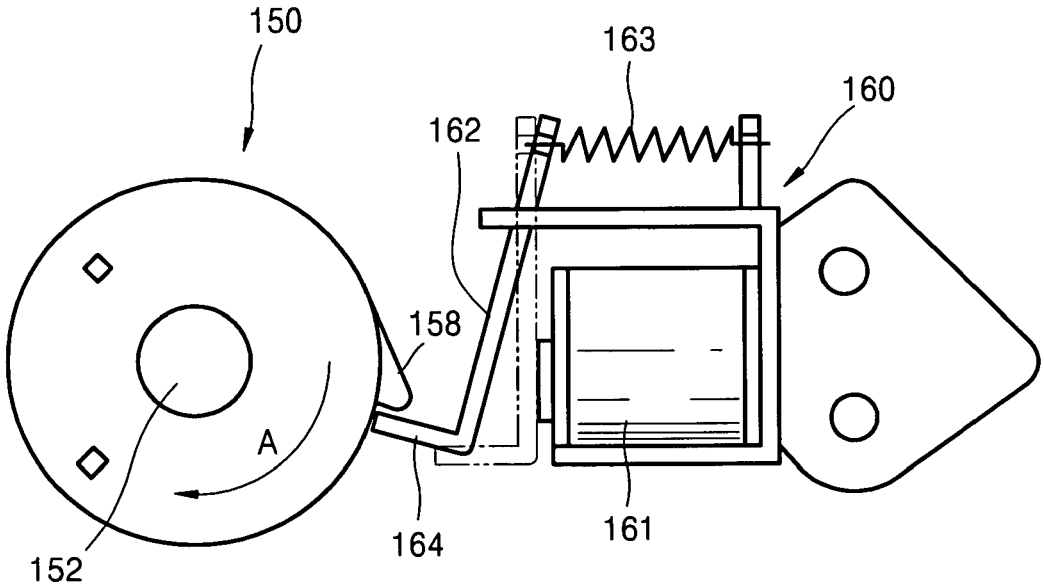
FIG. 10 is a side elevational view of a switching unit.

Referring to FIG. 10, when current is not applied to the coil 161, the stopping portion 164 of the shifting plate 162 is engaged with the coupling protrusion 158 of the clutch hub 157 to stop the rotation of the clutch hub 157. Since the other end 159*b* of the clutch spring 159 is inserted in the hole 156 of the clutch hub 157, the clutch spring 159 is twisted in a direction increasing its inner diameter when the rotation of the clutch hub 157 is stopped by the stopping portion 164 of the shifting plate 162. This causes the clutch spring 159 to loosely hold the end 153 of the driving shaft 151, such that the rotational motion of the driving shaft 151 is not transmitted to the driven shaft 152 through the clutch spring 159. When current is applied to the coil 161, the shifting plate 162 is pulled toward the coil 161 to disengage the stopping portion 164 from the coupling protrusion 158 of the clutch hub 157, as shown by the imaginary lines in FIG. 10. Therefore, rotational motion may be transmitted from the driving shaft 151 to the driven shaft 152.

Alternatively, the second shaft 52 may be divided into a driving shaft and a driven shaft instead of dividing the first shaft 51 into the driving shaft 151 and the driven shaft 152. The driving shaft of the second shaft 52 may be connected to the first shaft 51 by the universal shaft 54, and the driven shaft of the second shaft 52 may be formed with the worm gears 53Y, 53M, and 53C.

As described above, only the toner cartridge 11K is operated when a monochrome image is printed, and all the toner cartridges 11Y, 11M, 11C, and 11K are operated when a color image is printed. The switching unit may be provided in various forms and configurations in addition to the configuration shown in FIGS. 8 through 10.

According to an exemplary embodiment of the present invention, the electrophotographic color image forming apparatus provides advantageous effects as follows.

First, the toner cartridges are arranged in a staggered manner in the lengthwise directions of the developing units, such that the size of the image forming apparatus may be reduced. Also, when toner is used up, only the toner cartridge is replaced instead of replacing the entire developing unit, thereby reducing the cost for consumables.

Second, the plurality of toner cartridges may be driven with fewer components owing to the combination of the universal joint, shafts, and worm gears.

Third, the switching unit prevents the toner cartridges from being driven when they are not in use.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electrophotographic color image forming apparatus, comprising:

a photoconductor;

a plurality of developing units respectively including developer rollers to develop an electrostatic latent image formed on the photoconductor by applying toner to the electrostatic latent image;

a plurality of toner cartridges respectively including agitators and arranged in a lengthwise direction of the developer rollers to supply toner to the developing units;

a driving motor; and a plurality of shafts connected to each other through a universal joint to transmit rotational motion of the driving motor to the agitators.

2. The electrophotographic color image forming apparatus of claim 1, wherein the agitators and the developer rollers are substantially perpendicular to one another.

3. The electrophotographic color image forming apparatus of claim 2, wherein a plurality of pinions are respectively coupled to the agitators; and a plurality of worm gears are formed on the plurality of shafts to rotate the plurality of pinions.

4. The electrophotographic color image forming apparatus of claim 1, wherein the plurality of toner cartridges include black, yellow, cyan, and magenta toner cartridges; and the plurality of shafts include a first shaft connected to the driving motor to drive the agitator of the black toner cartridge; and a second shaft to drive the agitators of the yellow, cyan, and magenta toner cartridges.

5. The electrophotographic color image forming apparatus of claim 4, wherein a switching unit is disposed between the first and second shafts to selectively transmit driving force from the driving motor to the second shaft.

6. The electrophotographic color image forming apparatus of claim 5, wherein the switching unit includes a spring clutch; and a solenoid to selectively operate the spring clutch.

7. The electrophotographic color image forming apparatus of claim 1, wherein the plurality of toner cartridges are individually removable from their respective developing unit.

8. The electrophotographic color image forming apparatus of claim 7, wherein the plurality of toner cartridges extend externally of the image forming apparatus to facilitate insertion and removal of the toner cartridges.

9. An electrophotographic color image forming apparatus, comprising:

a plurality of developing units disposed in a rotational direction of a photoconductor, the developing units respectively including containers in which developer rollers are respectively installed and toner supplying portions extending from the containers;

a plurality of toner cartridges detachably installed to the toner supply portions, respectively;

a plurality of pinions respectively connected to the toner cartridges and having axes substantially perpendicular to the developer rollers;

a driving motor;

a first shaft disposed in a direction substantially parallel to the developer rollers and connected to the driving motor;

a second shaft connected to the first shaft by a universal joint at a predetermined angle; and a plurality of worm gears formed on the first and second shafts to rotate the plurality of pinions.

10. The electrophotographic color image forming apparatus of claim 9, wherein the plurality of toner cartridges include black, yellow, cyan, and magenta toner cartridges; and the worm gears include a worm gear formed on the first shaft to drive the pinion of the black toner cartridge; and three worm gears formed on the second shaft to drive the pinions of the yellow, cyan, and magenta toner cartridges.

11. The electrophotographic color image forming apparatus of claim 10, wherein a switching unit is connected between the first and second shafts to selectively transmit driving force from the driving motor to the second shaft.

12. The electrophotographic color image forming apparatus of claim 11, wherein the switching unit includes a spring clutch; and a solenoid to selectively operate the spring clutch.

13. The electrophotographic color image forming apparatus of claim 9, wherein the plurality of toner cartridges are individually removable from their respective developing unit.

14. The electrophotographic color image forming apparatus of claim 13, wherein the plurality of toner cartridges extend externally of the image forming apparatus to facilitate insertion and removal of the toner cartridges.

* * * * *